United States Patent [19]

Stima et al.

[11] Patent Number: 4,793,019

[45] Date of Patent: Dec. 27, 1988

[54] SPONGE MOP ATTACHMENT

[75] Inventors: Joseph F. Stima, Edison; Ligia A. Rivera, Brunswick, both of N.J.; John C. Crawford, Lake Mahopac, N.Y.

[73] Assignee: Colgate-Palmolive Company, Piscataway, N.J.

[21] Appl. No.: 92,018

[22] Filed: Sep. 2, 1987

[51] Int. Cl.[4] ..... A47L 13/19; A47L 13/257

[52] U.S. Cl. ..... 15/104.94; 15/118; 15/231; 15/244.1; 15/246

[58] Field of Search ..... 15/114, 116 A, 119 A, 15/228, 231, 232, 244 R, 244 A, 244 B, 246, 104.94, 233

[56] References Cited

U.S. PATENT DOCUMENTS

| | | | |
|---|---|---|---|
| D. 260,357 | 8/1981 | Brannan | D8/94 |
| D. 287,173 | 12/1986 | Libman | D32/51 |
| 1,656,981 | 1/1928 | Lewis . | |
| 1,927,574 | 9/1933 | Parks | 51/187 |
| 2,419,748 | 4/1947 | Weber et al. | 15/186 |
| 2,505,295 | 4/1950 | Meyers | 91/39 |
| 2,516,396 | 7/1950 | Kersch | 15/233 |
| 2,560,008 | 7/1951 | Steward | 15/233 |
| 2,698,955 | 1/1955 | Trindl | 15/244 |
| 2,710,981 | 6/1955 | Steiert | 15/131 |
| 2,735,126 | 2/1956 | Proffitt | 15/147 |
| 2,741,786 | 4/1956 | Bressler | 15/105 |
| 2,839,770 | 6/1958 | Boscarino, Jr. | 15/131 |
| 3,012,264 | 12/1961 | Nash | 15/231 |
| 3,471,977 | 10/1969 | Roth | 51/383 |
| 3,795,933 | 3/1974 | Seufert | 15/114 |
| 3,810,841 | 5/1974 | Richter | 252/91 |
| 3,828,386 | 8/1974 | Roth | 15/105 |
| 3,842,548 | 10/1974 | Stoneburner | 51/392 |
| 3,964,500 | 6/1976 | Drakoff | 132/7 |
| 3,991,431 | 11/1976 | Thielen | 15/147 A |
| 4,148,318 | 4/1979 | Meyer | 128/269 |
| 4,152,807 | 5/1979 | Smahlik | 15/246 |
| 4,184,221 | 1/1980 | Edwards | 15/114 |
| 4,225,998 | 10/1980 | Thielen | 15/231 |
| 4,337,166 | 6/1982 | Hill et al. | 252/174.15 |
| 4,475,835 | 10/1984 | Verboom et al. | 401/132 |
| 4,503,579 | 3/1985 | Nicely | 15/244 A |
| 4,523,347 | 6/1985 | Tames | 15/104.94 |
| 4,601,081 | 7/1986 | Sutton et al. | 15/104.94 |
| 4,613,446 | 9/1986 | Magyar | 252/91 |
| 4,624,890 | 11/1986 | Lloyd et al. | 428/290 |
| 4,639,321 | 1/1987 | Barrat et al. | 252/8.8 |
| 4,642,832 | 2/1987 | Trisolini | 15/3 |

FOREIGN PATENT DOCUMENTS

| | | | |
|---|---|---|---|
| 482840 | 4/1952 | Canada | 15/233 |

*Primary Examiner*—Edward L. Roberts

*Attorney, Agent, or Firm*—Murray M. Grill; Richard J. Ancel

[57] ABSTRACT

An attachment for a sponge mop, the attachment being in the form of an elongated clip which is U-shaped in transverse cross-section and whose legs are resilient, with the outer surface of the clip bight portion carrying a pad. The pad can be of a relatively abrasive material for scrubbing or can be of a buffer/polisher material. The legs of the clip releasably fasten onto opposite sides of the sponge. The attachment (when used as a scrubber) and sponge can both be squeezed by a hinged squeezing mechanism conventionally carried by such mops. The scrubber pad may carry a detergent composition, such detergent being wetted by liquid in the sponge by virtue of holes in the central portion of the clip. The attachment, as a scrubber, is clipped to a sponge mop whenever floor portions are encountered which require greater abrasion than that obtained from the sponge alone and is clipped to the sponge mop (with a different pad thereon) whenever floor buffing/polishing is desired. The pad may be releasably or permanently attached to the clip.

10 Claims, 2 Drawing Sheets

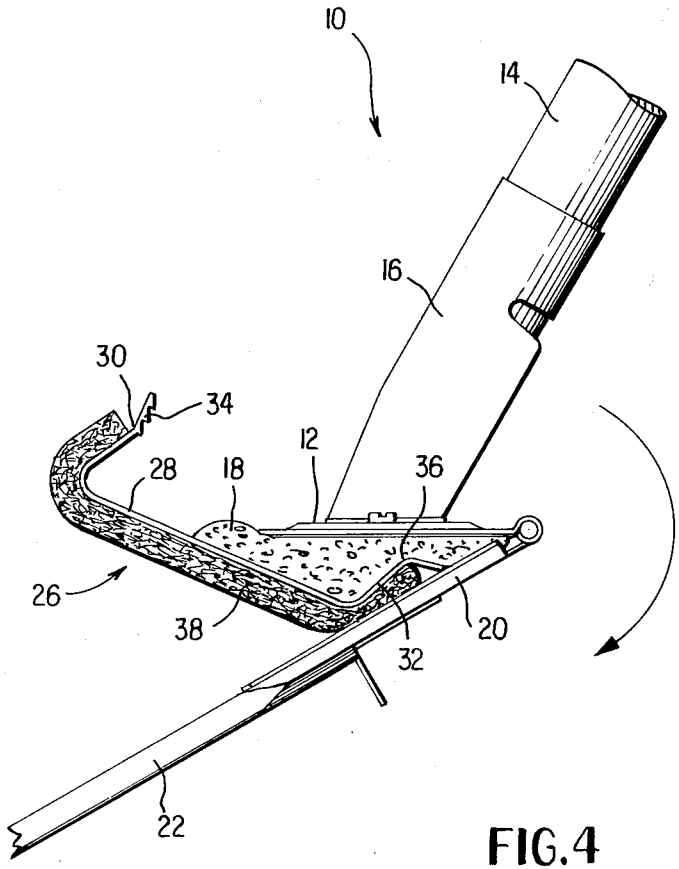
FIG. 4
FIG. 3
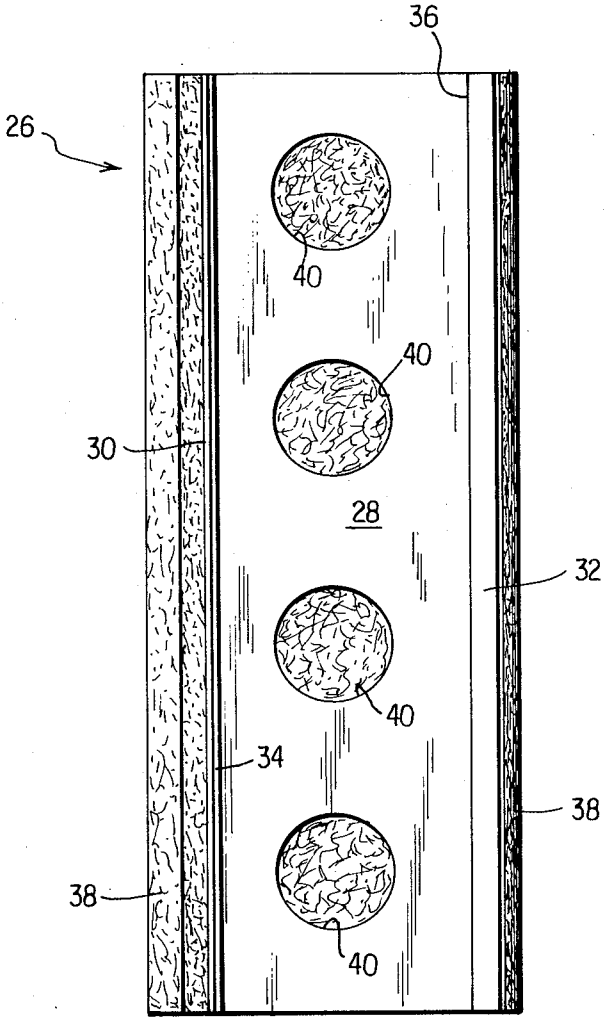

SPONGE MOP ATTACHMENT

BACKGROUND OF THE INVENTION

This invention relates to a device for cleaning and/or treating hard surfaces, and particularly textured surfaces, which device takes advantage of a popular household cleaning device, a sponge mop. This device is attached to a sponge mop by means of a clip which permits the releasable engagement thereof with the sponge of the sponge mop.

Sponge mops have enjoyed great commercial success, particularly those which are provided with some means or mechanism to permit the user, typically in a private home, to wring out the sponge and thereby rid it of water or other cleaning fluid which has become soiled during floor cleaning.

Modern surfaces, such as no-wax floors, counter tops, appliances, and ceramic tiles are becoming increasingly more textured to provide more versatility to the decor. Homemakers have found that removing embedded soil from the depressions of textured surfaces is difficult without laborious scrubbing. Sponge mops, which are used by a wide majority of the U.S. households, are not efficient in removing the embedded soils of textured surfaces because they are not resilient enough to penetrate into the grooves and do not have enough abrasive action. Thus, an improved system is needed to clean such textured surfaces.

BRIEF DESCRIPTION OF THE INVENTION

According to the practice of this invention, an attachment including a clip having inner and outer surfaces is releasably mounted on the sponge of an otherwise conventional sponge mop, wherein one outer or external surface portion of the clip carries a fabric or pad. If the attachment clip is to be employed as a scrubber, the pad is typically formed of a non-woven fabric, a woven fabric, or the like, and is of a resiliency and abrasiveness greater than that of the sponge. Thus, when the user requires extra effort or force to dislodge certain types of dirt or stains from an area of the hard surface being cleaned, or the whole floor surface, it is only necessary to place the clip attachment on the sponge and then proceed to clean the particularly dirty floor area while still standing, using the same motions as before, thereby converting a conventional sponge mop into an efficient cleaning tool for cleaning flat or embossed, textured, non-porous surfaces, such as no-wax floors, ceramic tiles and the like.

Additionally, the attachment is so constructed that the sponge of the sponge mop, while carrying the attachment, can still be squeezed to release any excess water from the sponge in a manner entirely analogous to squeezing the sponge itself when used without the clip attachment of this invention. Thus, the clip attachment not only permits the user to employ a more abrasive material than a sponge to clean the floor, or certain areas of the floor, but it also permits the same method of squeezing excess water or dirty liquid by using the hinged lever mechanism conventionally provided on the mop. Further, the fabric on the outer clip surface can be impregnated with detergent compositions during manufacture of the scrubber attachment, to thereby maximize cleaning and scrubbing effectiveness.

The clip may, alternatively, be provided with different types of pad-forming substrates for different functions thereby making the sponge mop a more useful, versatile tool. For example, if desired to be used for polishing the floors, a pad formed of a non-woven or woven fabric can be impregnated with a polishing compound thereby providing a sponge mop which can be used as a floor polisher or buffer.

BRIEF DESCRIPTION OF THE DRAWINGS

FIG. 3 is a top plan view of the clip attachment of this invention.

FIG. 4 is a view similar to FIG. 2 and illustrates the sponge and clip attachment being squeezed.

DETAILED DESCRIPTION OF THE INVENTION

Figure 2:
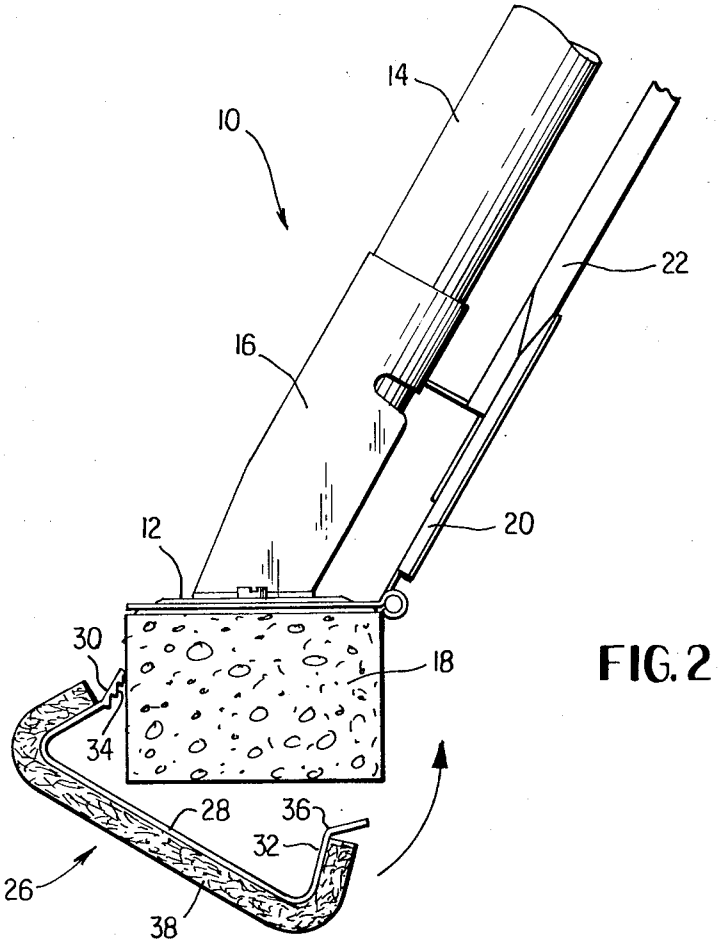
FIG. 2 is an end view of the mop of FIG. 1, and illustrates how the clip attachment is placed on the mop sponge.

Referring now to the drawings, the numeral 10 denotes a typical sponge mop of known construction, the mop including a mop head 12 fashioned from a rigid material, such as sheet metal or a hard plastic material. The numeral 14 denotes an elongated handle secured into a socket 16 carried on top of mop head 12. The number 18 denotes a sponge of generally rectangular parallelepiped form whose top surface is conventionally secured to mop head 12, as by screws received by a plastic sheet adhesively secured to the top of the sponge, or by any other method. The numeral 20 denotes a conventional sponge squeezing or wringing attachment, being a rigid sheet metal plate pivotally carried by mop head 12 at one edge of the latter and having a handle 22. Those elements thus far described are already known in this art.

The numeral 26 denotes the scrubber attachment of this invention, the attachment being generally elongated and U-shaped in transverse cross-section. The attachment is formed in two pieces, the first piece being a semi-rigid clip fashioned from, typically, extruded thermoplastic material, such as polyvinyl chloride (PVC), from 0.01 to 0.10 inches thick, and an outer pad fashioned, typically, from a spray bonded non-woven, 100% polyester having a PVC binder (20–70% by weight), which can be used as a scrubber. The clip may also be fashioned of polymeric plastic, paperboard treated for moisture resistance, plastic coated wire, metal or wood. The clip includes a bight portion 28 (flat over most of its width) having two legs 30 and 32 depending from it, legs 30 and 32 being opposite to and facing each other. Leg 30 is provided at the inner surface of its free edge with a plurality of serrations 34, preferably molded into it, while leg 32 includes an inwardly bent portion 36 below its free edge. The numeral 38 denotes the second attachment piece and is shown as a scrubber pad permanently affixed to the external surface of bight portion 28 of the clip by means of an adhesive or the like and, preferably, having end portions or edges which extend partially along the exterior surfaces of the bases of legs 30 and 32 and which may also be adhesively secured to these leg portions. Alternatively, the adhesive may be applied only to these leg portions. The pad may also be releasably secured to bight portion 28 and legs 30, 32 as well as being permanently fixed thereto.

Examples of releasable pads on a scrubbing or brushing device are afforded by U.S. Pat. Nos. 1,656,981 to Lewis; 1,927,574 to Parks; 3,012,264 to Nash; 3,842,548 to Stoneburner; 4,184,221 to Edwards; and 4,152,807 to Smahlik.

As shown at FIG. 3, the bight portion 28 carries a plurality of through apertures or openings 40, for a purpose which will presently be described. As indicated at FIG. 2, attachment 26 is placed on sponge 18 by engaging the knurled or serrated portion 34 of leg 30 to one of the opposite and parallel surfaces of the sponge and then rotating, in the direction of the curved arrow, the attachment so that the other leg 32 frictionally engages an opposite and parallel surface of sponge 18. The resiliency of legs 30 and 32 is such that the sponge is frictionally engaged by the clip attachment 26, the legs 30 and 32 bending somewhat outwardly upon attachment to the sponge.

Figure 1:
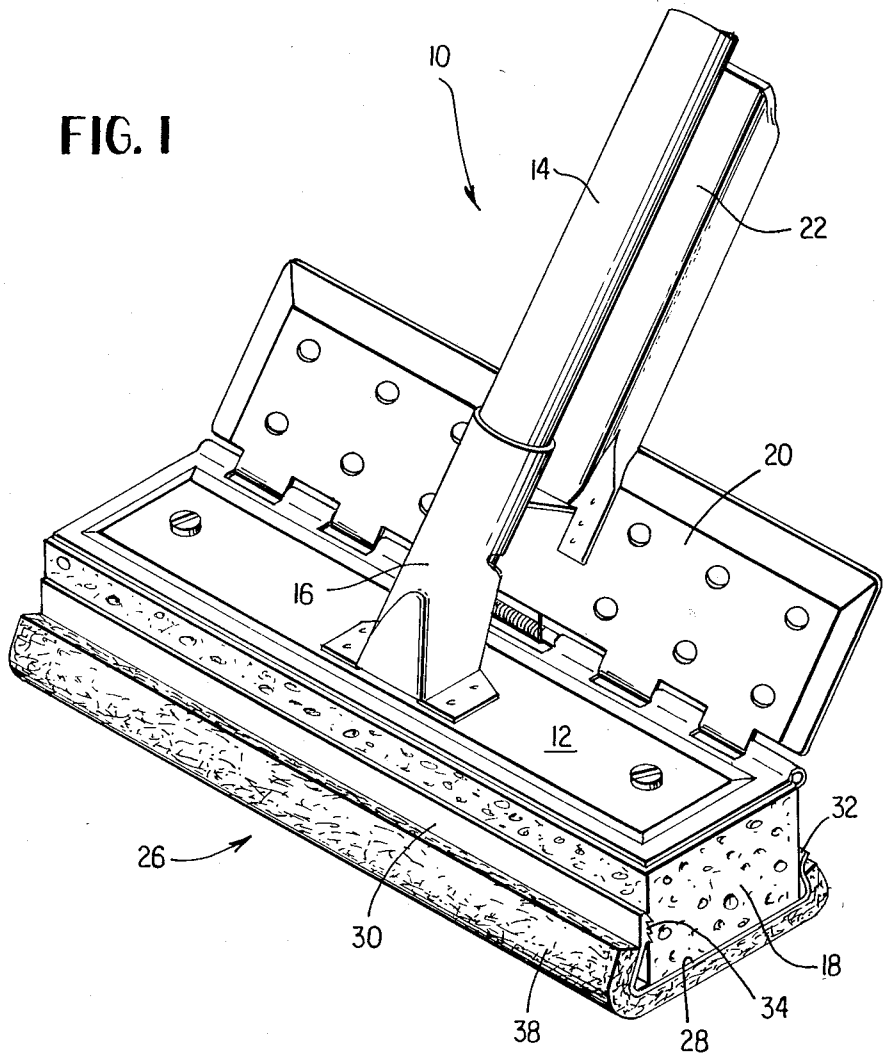
FIG. 1 is a partial perspective view of an otherwise conventional sponge mop carrying the clip attachment of this invention.

The attachment and mop are operated in the following manner. The user clips the attachment 26 to the sponge, as indicated at FIGS. 1 and 2. The user then immerses the mop head in a bucket of water, where a cleaner concentrate (that may have been previously impregnated in the pad) is released. Alternatively, the pad may be free of detergent, which may be added to the water by the user. The user proceeds to remove the mop head from the bucket and wring the sponge mop by rotating handle 22, with both the attachment and the sponge being squeezed by the compressive force of the squeezing plate 20, as shown in FIG. 4. The openings 40 assist in ensuring that the water trapped in the sponge can be removed and that the pad 38 has sufficient liquid to effect the desired scrubbing and cleaning. If the user's sponge mop has a different squeezing mechanism than the one shown in FIG. 1, a portion of the excess water retained by the sponge 18 can still pass downwardly, under the force of gravity, through openings 40 in bight portion 28.

Preferably, the length of scrubber attachment 26 is coextensive with sponge 18, although it may be made shorter or longer. In one embodiment of the invention, holes 40 are one inch in diameter, the length of the clip is 8.25 inches and its maximum width is about 2.6 inches. The slope of leg 32, relative to bight 28, is 61 degrees, while the slope of leg 30 is 65 degrees. The long sides of the serrations 34 slope 64 degrees, with the vertical height of each being 0.1 inch and the horizontal extent of each being about 0.04 inch. The distance between serrations 34 and bend 36 is about 2.0 inches.

As mentioned above, pad 38 can be provided with a premeasured quantity of a detergent composition. This minimizes residue build-up on the hard surface, which build-up tends to cause such treated surfaces to look dull and hazy. In this embodiment, the water from the sponge 18 passes through openings 40 to dissolve the detergent in the pad. One suitable composition for such a pad is:

| | |
|---|---|
| $SO_3$ High AI base (alkyl benzene sulfonate) | 76.7% |
| Deionized water | 11.2% |

-continued

| | |
|---|---|
| Primary alcohol ethoxylate | 10.6% |
| Dow 244 Fluid (Polysiloxane) | 1.0% |
| Perfume | 0.5%–2% |

In a typical embodiment of the invention, the pad 38, suitable for use as a scrubber, is formed of spray-bonded non-woven fabric, Bristle-Tex non-woven fabric, flocked foam, brush bristle compositions, abrasive/-foam composites, steel wool, or plastic mesh and is secured to the external bight portion of the semi-rigid PVC clip by means of a hot melt adhesive. Other pads which can be affixed to the clip include pads specifically adapted for: spreading and buffing wax; painting; drying floors; cleaning windows; cleaning automobiles or boat decks; scrubbing floors; or cleaning walls. A pad adapted to act as a squeegee can also be utilized.

What is claimed is:

1. An attachment for a sponge mop including a mop head and a sponge, the attachment comprising:

(a) a clip attachment having inner and outer surfaces, said attachment adopted to be releasably secured to the mop head, said attachment including an elongated, semi-rigid clip which is generally U-shaped in transverse cross section, to thereby define a central bight portion integrally secured to two legs, said bight portion having an exterior surface, said legs each having a free edge and an inner surface adapted to clampingly and frictionally engage opposite, parallel surfaces of the sponge, the inner surface of at least one of said legs being provided adjacent its free edge with serrations, the exterior surface of the bight portion of the clip being adapted to be covered with a floor contacting material to thereby define a pad; and b. a pad having a generally planar outer or front surface for contacting hard surfaces.

2. The attachment of claim 1 wherein said pad is adapted to retain or dispense detergent active formulations.

3. The attachment of claim 1, wherein said pad also extends partially along the exterior surface of the bases of the legs of the clip.

4. The attachment of claim 1, wherein said pad is a coarse, resilient, porous material adapted to scrub a soiled surface.

5. The attachment of claim 4, wherein said pad is 100% polyester with a polyvinyl chloride binder up to about 30% by weight of the pad.

6. The attachment of claim 1, wherein one of said legs is provided adjacent the inner surface of its free edge with serrations and wherein the other of the legs is provided with an inwardly extending bend adjacent its free edge.

7. The attachment of claim 1, wherein said clip is formed of thermoplastic polymer.

8. The attachment of claim 1, wherein said pad is impregnated with a detergent active composition.

9. The attachment of claim 1, wherein said pad is formed of a buffer material.

10. The attachment of claim 1 wherein said pad is permanently affixed to said clip.

* * * * *